US005375334A

United States Patent [19]

Coker

[11] Patent Number: 5,375,334

[45] Date of Patent: Dec. 27, 1994

[54] DOORFRAME TEMPLATE APPARATUS

[76] Inventor: Michael A. Coker, 1201 Inwood La., Pasadena, Tex. 77502

[21] Appl. No.: 72,444

[22] Filed: Jun. 7, 1993

[51] Int. Cl.[5] ..... G01B 5/24

[52] U.S. Cl. ..... 33/194; 33/414; 33/471

[58] Field of Search ..... 33/194, 465, 471, 472, 33/413, 414, 538

[56] References Cited

U.S. PATENT DOCUMENTS

| | | | |
|---|---|---|---|
| 577,708 | 2/1897 | Barrie | 33/413 |
| 977,735 | 12/1910 | Hansen | 33/194 |
| 1,101,517 | 6/1914 | Ahlvin | 33/194 |
| 2,973,584 | 3/1961 | Snapp | 33/194 |
| 4,223,445 | 9/1980 | Goodland | 33/194 |
| 4,451,993 | 6/1984 | Yauk | 33/472 |
| 4,562,649 | 1/1986 | Ciavarella | 33/465 X |
| 4,910,876 | 3/1990 | Channell | 33/194 X |

*Primary Examiner*—Alvin Wirthlin

[57] ABSTRACT

A doorframe template apparatus is provided which includes a T-shaped first straight edge member which includes a straight top member and a straight middle member extending perpendicularly from a middle portion of the top member. The straight top member includes a top flange member and a bottom flange member at right angles to the straight middle member. A second straight edge member is connected to the straight middle member by a lockable pivoted joint. The lockable pivoted joint enables the T-shaped first straight edge member to be adjusted with respect to the second straight edge member at angles that conform to respective doorframe angles when the straight top member of the T-shaped first straight edge member is placed against a doorjamb, and the second straight edge member is placed against a horizontal doorframe member. The straight middle member includes a first aperture. The second straight edge member includes a second aperture, and the lockable pivoted joint includes a threaded bolt and a lock nut secured to the threaded bolt. The threaded bolt passes through the first aperture and second aperture when the first aperture and the second aperture are placed in registration. The second straight edge member 14 may include an inner member and an outer member that is adjustable with respect to the inner member. A chalk line assembly may be connected to the second straight edge member.

7 Claims, 4 Drawing Sheets

DOORFRAME TEMPLATE APPARATUS

BACKGROUND OF THE INVENTION

1. Field of the Invention

The present invention relates generally to devices for assisting in an accurate fit between a doorframe and a door installed therein, and more particularly, to a doorframe template apparatus, especially adapted for assuring that the shape of the door conforms to the shape of the doorframe.

2. Description of the Prior Art

Ideally, doorframes and the doors installed therein have a perfect fit. In reality, adjacent sides of manufactured doors are very nearly at right angles to each other. However, tile doorframes in which the doors are installed often have adjacent sides that are not at right angles to one another. This lack of right angularity can be due to a number of causes ranging from poor building technique to a house settling over time. In this respect, it is often difficult to fit a rectangular door in a non-rectangular doorframe. Since it is easier to trim a rectangular door to conform to a non-rectangular doorframe than vice versa, it would be desirable if a device were provided that was adapted to assure that the shape of the door conforms to the shape of the doorframe.

When the shape of a doorframe, or a portion of a doorframe is determined, that shape must somehow be retained or remembered so that it can be transferred to a door so the door can be adjusted to conform to the shape of the doorframe. In this respect, it would be desirable if a device were provided that retained the shape of a doorframe so that the retained shape can be transferred to a door.

In working on door installations, it would be desirable if tools that are used are lightweight and easy to operate. In this respect, it would be desirable if a door shape adjusting device were provided that is lightweight and easy to operate.

A doorframe has four corners. Rather than having big bulky tools that would be used to measure all four corners simultaneously, it would be desirable if a doorframe device were provided that measured one corner at a time but that was easily adjusted to successively measure all four corners.

A doorframe has two relatively Icing vertical doorjambs and one relatively short horizontal top frame member. The horizontal floor directly below the top frame member may also be considered to be a horizontal member importantly related to proper door installation. Each corner of the doorframe results from a meeting of a relatively long vertical doorjamb and a relatively short horizontal member. In this respect, it would be desirable if a doorframe device were provided that included a relatively long portion to conform to a vertical doorjamb and a relatively short portion to conform to a horizontal portion of the doorframe.

Once the shape of a doorframe corner is determined and retained by a doorframe device, the retained shape of the corner must be accurately transferred to a door, so that the shape of the door can be altered accordingly. In this respect, it would be desirable if a doorframe device were provided that permits accurate transfer of the shape of the doorframe corner to the door.

Heights and widths of doorframes vary from place to place. Yet, for most purposes, doorframes are at least six feet high and at least two feet wide. Generally, there is more variation in width than in height. Therefore, it would be desirable if a doorframe device were provided that was adjustable with respect to doorframe width.

A number of devices are known in the prior art which are used for determining corner angles. For example, the following U.S. patents disclose adjustable squares: U.S. Pat. Nos. 4,525,933; 4,562,649; 4,697,351; 4,729,173; and U.S. Pat. Des. No. 260,616. More specifically, all of the patents just cited disclose general purpose squares. None of them are disclosed as having features specifically provided for assuring that the shape of a door conforms to the shape of the doorframe. Moreover, these cited patents do not teach their use in assuring that the shape of a door conforms to the shape of the doorframe. In this respect, it would be desirable if a square device were provided which possessed specific features designed for assuring that the shape of a door conforms to the shape of the doorframe.

When using a square, a line is often drawn using an edge of the square. Often, during the course of drawing the line, the square slips, and the line that is drawn is not a straight line. In this respect, it would be desirable if a square device were provided that assured that a straight line were drawn on a door.

Strings loaded with chalk powder are referred to as chalk lines. Chalk lines are often used to mark a surface for marking a straight line. In use, a string may develop some slack and no longer deposit chalk on the surface in the form of a straight line. In this respect, it would be desirable if a marking device were provided that employed a chalk line and that had provisions to assure that the chalk line remains taut and straight.

When chalk lines arc used, some portion of the chalk powder leaves the line to be deposited on the surface being marked. In this respect, it would be desirable if a chalk line device were provided for marking a door wherein a supply of chalk is provided to replenish chalk depleted from the chalk line.

A chalk replenishing supply need not be present on the chalk line device at all times. It is intended to be used only when it is needed. In this respect, it would be desirable if a chalk line device were provided in which a chalk supply can be readily added to or removed from the support for the chalk line.

Thus, while the foregoing body of prior art indicates it to be well known to use generic squares for a variety of purposes, the prior art described above does not teach or suggest a doorframe template apparatus which has the following combination of desirable features: (1) has features to assure that the shape of the door conforms to the shape of the doorframe; (2) retains the shape of a doorframe so that the retained shape can be transferred to a door; (3) is lightweight and easy to operate; (4) is easily adjusted to successively measure all four corners of the doorframe; (5) includes a relatively long portion to conform a vertical doorjamb and a relatively short portion to conform to a horizontal portion of the doorframe; (6) permits accurate transfer of the shape of the doorframe corner to the door; (7) is adjustable with respect to doorframe width; (8) is a square device which possesses specific features designed for assuring that the shape of a door conforms to the shape of the doorframe; (9) assures that a straight line is drawn on a door; (10) employs a chalk line with provisions to assure that the chalk line remains taut and straight; (11) provides a supply of chalk to replenish depleted chalk; and (12) provides a chalk supply that can be readily be added to or removed from the support for the chalk line. The foregoing desired characteristics are provided by the unique doorframe template apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved doorframe template apparatus for use with a doorframe which has vertical doorjambs and horizontal doorframe members spanning between the doorframe members. The apparatus includes a T-shaped first straight edge member which includes a straight top member and a straight middle member extending perpendicularly from a middle portion of the top member. The straight top member includes a top flange member and a bottom flange member at right angles to the straight middle member. A second straight edge member is connected to the straight middle member by a lockable pivoted joint. The lockable pivoted joint enables the T-shaped first straight edge member to be adjusted with respect to the second straight edge member at angles that conform to respective doorframe angles when the straight top member of the T-shaped first straight edge member is placed against a doorjamb, and the second straight edge member is placed against a horizontal doorframe member.

The straight middle member includes a first aperture. The second straight edge member includes a second aperture, and the lockable pivoted joint includes a threaded bolt and a lock nut secured to the threaded bolt. The threaded bolt passes through the first aperture and second aperture when the first aperture and the second aperture are placed in registration.

The second straight edge member includes an upper straight edge and a lower edge which includes a curved portion located near the second aperture, such that the second straight edge member is capable of being rotated around the threaded bolt without being prevented from rotating by bottom flange member of the straight top member. An inner side of the second straight edge member includes a series of indicia which indicate a number of angles at which the second straight edge member can be oriented with respect to the T-shaped first straight edge member.

A top portion of the straight middle member of the T-shaped first straight edge member includes an obtuse-angled notched edge which permits the indicia to be viewed by a user of the apparatus. The second straight edge member includes an inner member and an outer member connected to the inner member. The outer member is adjustable relative to the inner member. The inner member and the outer member include a plurality of adjustment apertures which are capable of being placed in registration and secured to each other by second straight edge locking assemblies.

A top surface of the bottom flange member and a top surface of the outer member are coplanar with respect to plane of the door, such that when the T-shaped first straight edge member and the second straight edge member are placed on the door, both the T-shaped first straight edge member and the second straight edge member are coplanar with the door.

A chalk line assembly may be connected to the second straight edge member. The chalk line assembly may include a first chalk line support bracket attached to the second straight edge member, a second chalk line support bracket attached to the second straight edge member, a portion of a chalk line extending between the first chalk line support bracket and the second chalk line support bracket, and a chalk line locking assembly for locking the portion of the chalk line which extends between the first chalk line support bracket and the second chalk line support bracket in a taut and straight orientation. The first chalk line support bracket may be attached to the inner member, and the second chalk line support bracket may be attached to the outer member of the second straight edge member.

A chalk powder supply assembly may be removably and replaceably attachable to the second straight edge member, for retaining a supply of chalk powder to be applied to the chalk line. The chalk powder supply assembly may include a slotted applicator member and a base member for supporting the slotted applicator member. The base member may include spring-loaded button members which fit into complementary wells in the second straight edge member, such that the chalk powder supply assembly may be secured to the second straight edge member when the spring-loaded button members are fitted into the wells.

The second straight edge member may include a cavity for receiving the chalk powder supply assembly.

The above brief description sets forth rather broadly the more important features of tile present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved doorframe template apparatus which has all of the advantages of the prior art and none of the disadvantages.

It is another object of the present invention to provide a new and improved doorframe template apparatus which may be easily and efficiently manufactured and marketed.

It is a further object of the present invention to provide a new and improved doorframe template apparatus which is of durable and reliable construction.

An even further object of the present invention is to provide a new and improved doorframe template apparatus which is susceptible of a low cost of manufacture with regard to both materials and labor, and which accordingly is then susceptible of low prices of sale to the consuming public, thereby making such doorframe template apparatus available to the buying public.

Still yet a further object of the present invention is to provide a new and improved doorframe template apparatus which has features to assure that the shape of the door conforms to the shape of the doorframe.

Still another object of the present invention is to provide a new and improved doorframe template apparatus that retains the shape of a doorframe so that the retained shape can be transferred to a door.

Yet another object of the present invention is to provide a new and improved doorframe template apparatus which is lightweight and easy to operate.

Even another object of the present invention is to provide a new and improved doorframe template apparatus that is easily adjusted to successively measure all four corners of the doorframe.

Still a further object of the present invention is to provide a new and improved doorframe template apparatus which includes a relatively long portion to conform to a vertical doorjamb and a relatively short portion to conform to a horizontal portion of the doorframe.

Yet another object of the present invention is to provide a new and improved doorframe template apparatus that permits accurate transfer of the shape of the doorframe corner to the door.

Still another object of the present invention is to provide a new and improved doorframe template apparatus which is adjustable with respect to doorframe width.

Yet another object of the present invention is to provide a new and improved doorframe template apparatus which possesses specific features designed for assuring that the shape of a door conforms to the shape of the doorframe.

Still a further object of the present invention is to provide a new and improved doorframe template apparatus that assures that a straight line is drawn on the door.

Yet another object of the present invention is to a new and improved doorframe template apparatus which employs a chalk line with provisions to assure that the chalk line remains taut and straight.

Still a further object of the present invention is to provide a new and improved doorframe template apparatus that provides a supply of chalk to replenish depleted chalk.

Yet another object of the present invention is to provide a new and improved doorframe template apparatus which provides a chalk supply that can be readily be added to or removed from the support for the chalk line.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
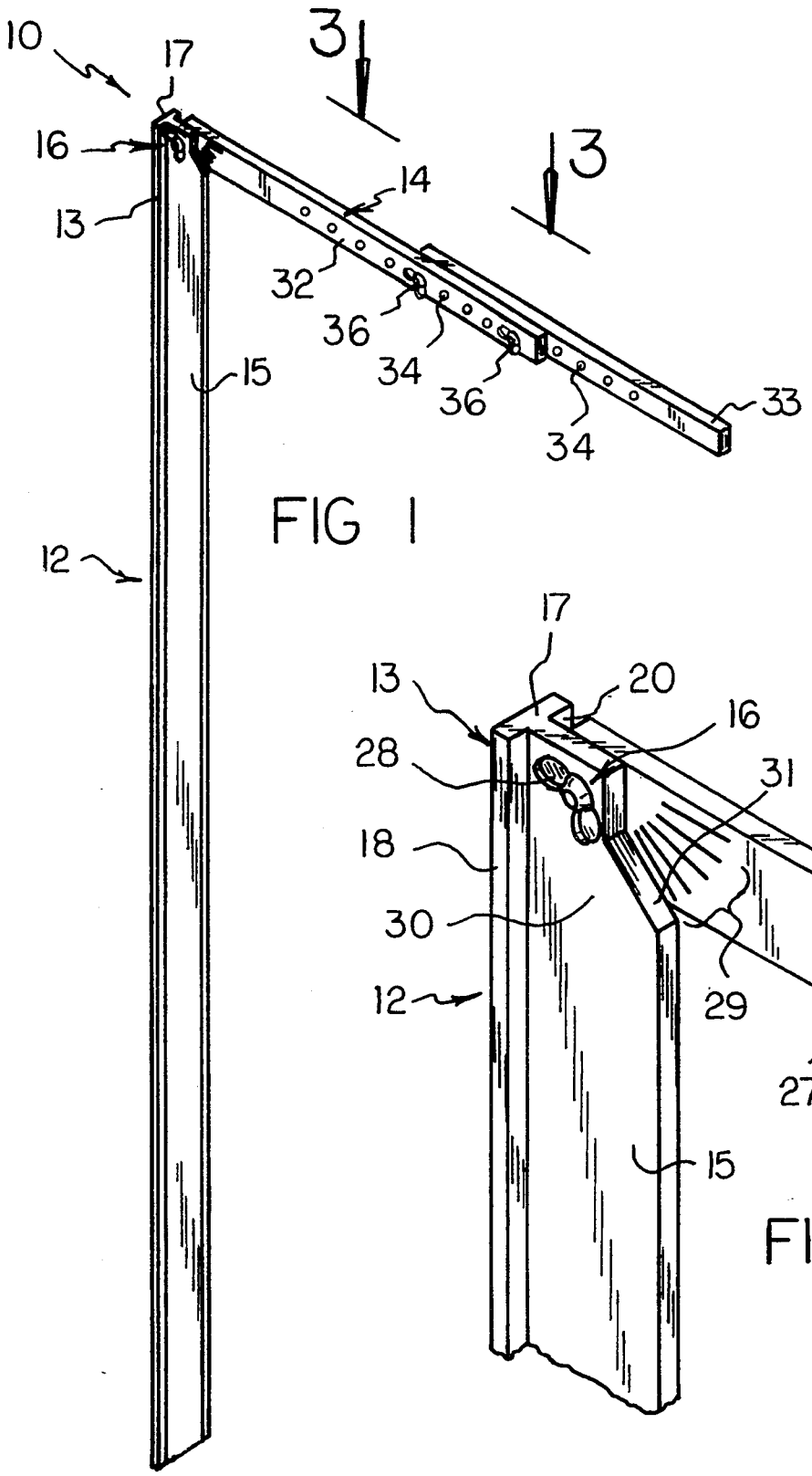
FIG. 1 is a perspective view showing a first preferred embodiment of the doorframe template apparatus of the invention.

With reference to the drawings, a new and improved doorframe template apparatus embodying the principles and concepts of the present invention will be described.

Turning initially to FIGS. 1–4, there is shown a first exemplary embodiment of the doorframe template apparatus of the invention generally designated by reference numeral 10. The doorframe template apparatus is provided for use with a doorframe which has vertical doorjambs and horizontal doorframe members spanning between the doorframe members. In it preferred form, the apparatus includes a T-shaped first straight edge member 12, which is about six feet long, which includes a straight top member 13 and a straight middle member 15 extending perpendicularly from a middle portion 17 of the top member 13. The straight top member 13 includes a top flange member 18 and a bottom flange member 20 at right angles to the straight middle member 15. A second straight edge member 14 is connected to the straight middle member 15 by a lockable pivoted joint 16. The lockable pivoted joint 16 enables the T-shaped first straight edge member 12 to be adjusted with respect to the second straight edge member 14 at angles that conform to respective doorframe angles when the straight top member 13 of the T-shaped first straight edge member 12 is placed against a doorjamb, and the second straight edge member 14 is placed against a horizontal doorframe member.

The straight middle member 15 includes a first aperture 22. The second straight edge member 14 includes a second aperture 24, and the lockable pivoted joint 16 includes a threaded bolt 26 and a lock nut 28 secured to the threaded bolt 26. The threaded bolt 26 passes through the first aperture 22 and second aperture 24 when the first aperture 22 and the second aperture 24 are placed in registration.

The second straight edge member 14 includes an upper straight edge 19 and a lower edge 21 which includes a curved portion 23 located near the second aperture 24, such that the second straight edge member 14 is capable of being rotated around the threaded bolt 26 without being prevented from rotating by bottom flange member 20 of the straight top member 13. If the lower edge 21 had a right angled corner 25 such as present on upper straight edge 19, then the bottom flange member 20 of the straight top member 13 would block or prevent a full range of rotation, and such a right angled corner would bump up against the bottom flange member 20. To prevent such an obstruction in rotation, the curved portion 23 of the lower edge 21 is present.

In operation, the lock nut 28 is loosened permitting the second straight edge member 14 to pivotably rotate with respect to the T-shaped first straight edge member 12 around the lockable pivoted joint 16. For a first doorframe corner, such as the upper left corner, the T-shaped first straight edge member 12 is placed against the hinge-side doorjamb, and the second straight edge member 14 is placed against the top horizontal doorframe member. In this respect, the T-shaped first straight edge member 12 and the second straight edge member 14 are oriented to each other at an angle conforming to the angle of the first doorframe corner. The lock nut 28 is tightened to lock the T-shaped first straight edge member 12 and the second straight edge member 14 together at the angle of the first doorframe corner. Then, the doorframe template apparatus 10 is placed in registration with the first corner of a door (not shown). More specifically, the bottom flange member 20 is placed in registration with the left edge of the door. When the bottom flange member 20 is in registration with the left edge of the door, the second straight edge member 14 is in registration with the top of the door at the angle of the first doorframe corner. Then a line is drawn on the door along the upper straight edge 19 of the second straight edge member 14. The line drawn on the door, following these steps, conforms to the angle of the first doorframe corner. If the door is trimmed along this line conforming to the angle of the first doorframe corner, then the trimmed door will conform to the angle of the first doorframe corner. The same procedure can be repeated for other doorframe corners so that each respective corner of the door will conform to each respective corner of the doorframe.

Figure 2:
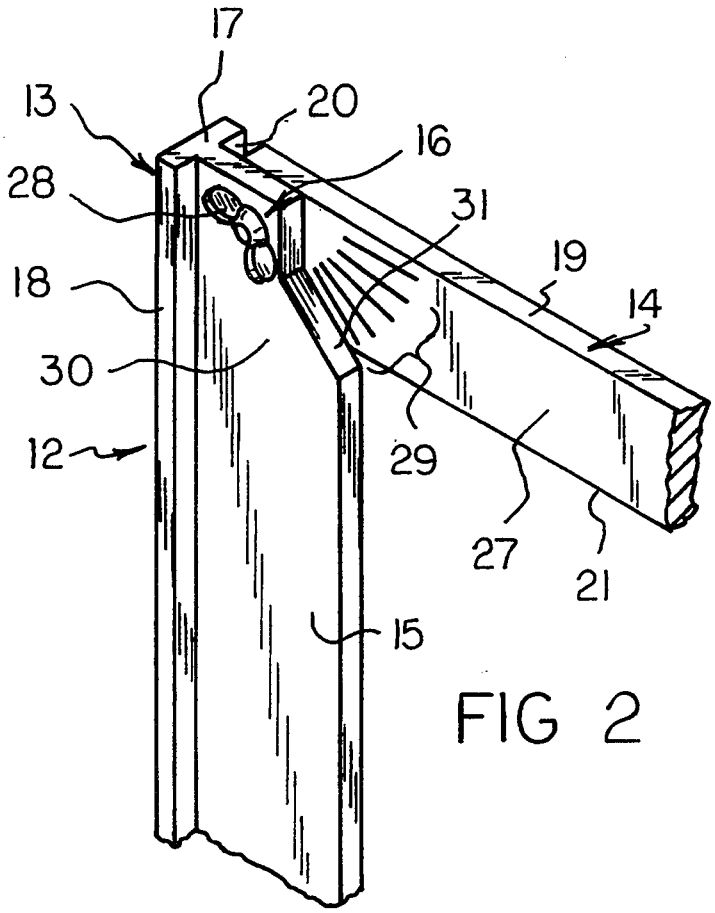
FIG. 2 is an enlarged perspective view of a corner portion of the embodiment of the invention shown in FIG. 1.

As shown in FIG. 2, the inner side 27 of the second straight edge member 14 includes a series of indicia 29 which indicate a number of angles at which the second straight edge member 14 can be oriented with respect to the T-shaped first straight edge member 12.

A top portion 30 of the straight middle member 15 of the T-shaped first straight edge member 12 includes an obtuse-angled notched edge 31 which permits the indicia 29 to be viewed by a user of the apparatus. If the obtuse-angled notched edge 31 were not present, that is if the upper right corner of the straight middle member 15 were right angled, then the indicia 29 would not be visible to a user of the apparatus. The second straight edge member 14 includes an inner member 32 and an outer member 33 connected to the inner member 32. The outer member 33 is adjustable relative to the inner member 32. The inner member 32 and the outer member 33 include a plurality of adjustment apertures 34 which are capable of being placed in registration and secured to each other by second straight edge locking assemblies 36. The inner member 32 and the outer member 33 are adjustable so as to provide an effective length of the second straight edge member 14 in a range from two to three feet. The inner member 32 and the outer member 33 may be telescopically adjustable to each other.

Figure 4:
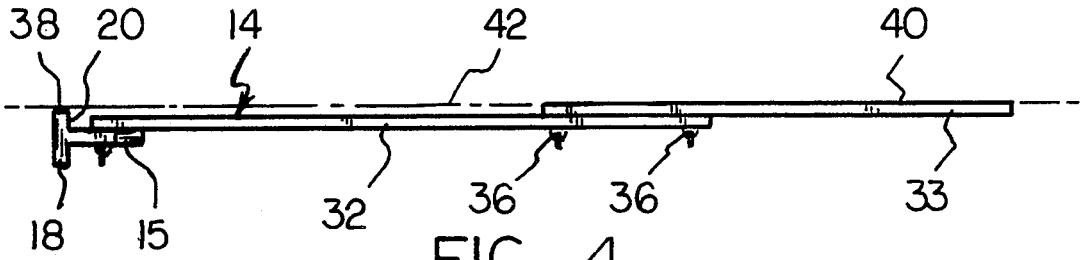
FIG. 4 is a top view of the doorframe template apparatus shown in FIG. 1 taken along the line 3—3 thereof.
Figure 3:
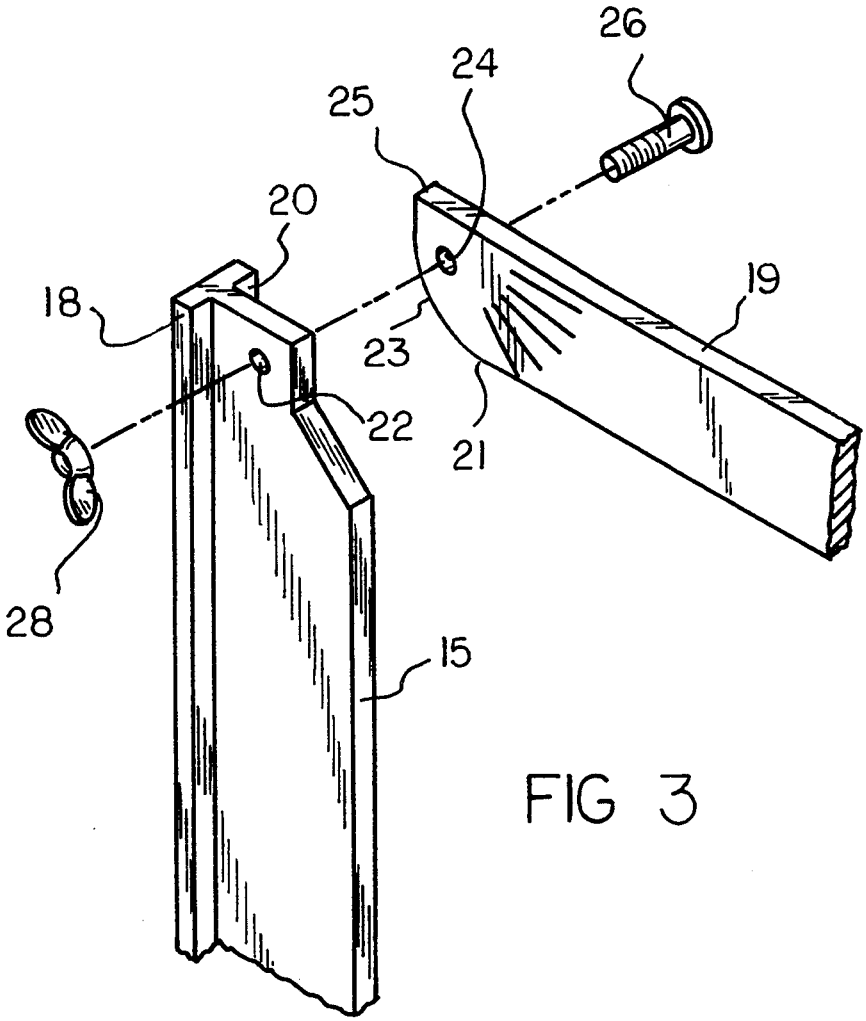
FIG. 3 is an exploded view of the corner portion of the doorframe template apparatus of the invention shown in FIG. 2.

As shown in FIG. 4, a top surface 38 of the bottom flange member 20 and a top surface 40 of the outer member 33 are coplanar with respect to plane 42 of a door, such that when the T-shaped first straight edge member 12 and the second straight edge member 14 are placed on the door, both the T-shaped first straight edge member 12 and the second straight edge member 14 are coplanar with the door.

Figure 5:
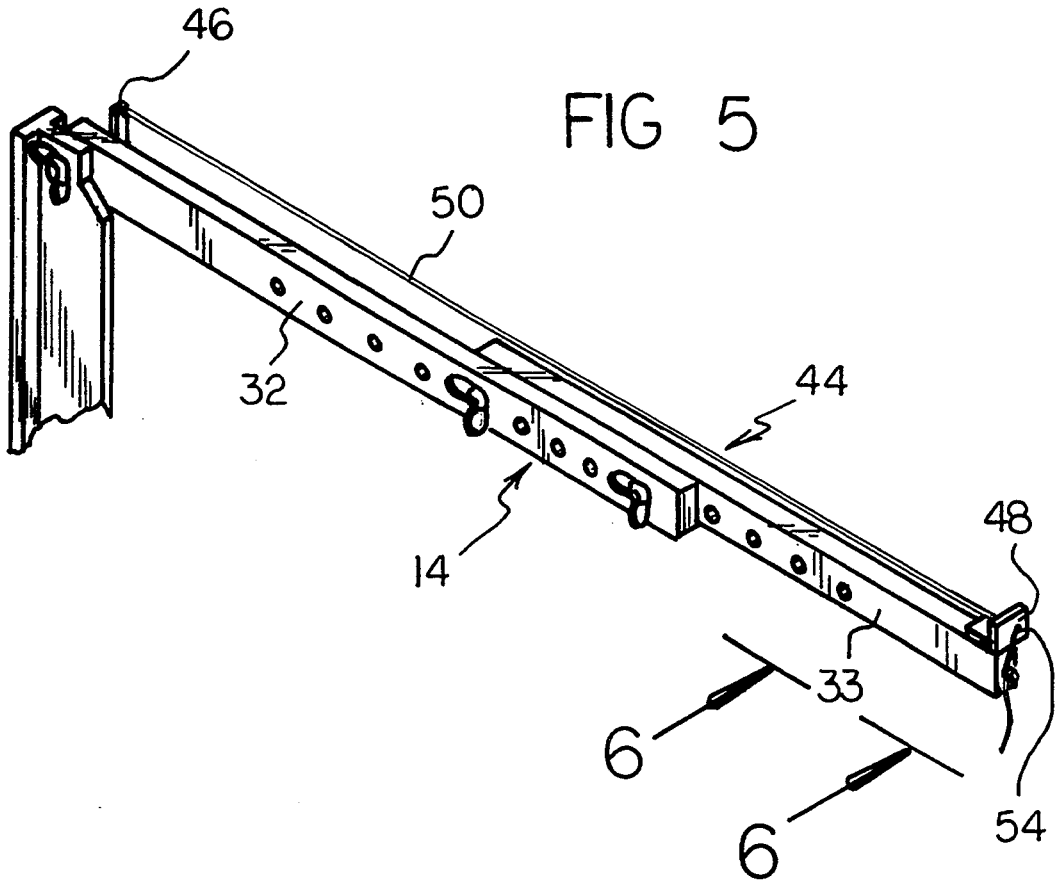
FIG. 5 is a perspective view of the top portion of a second preferred embodiment of the doorframe template apparatus of the invention showing a chalk line.
Figure 6:
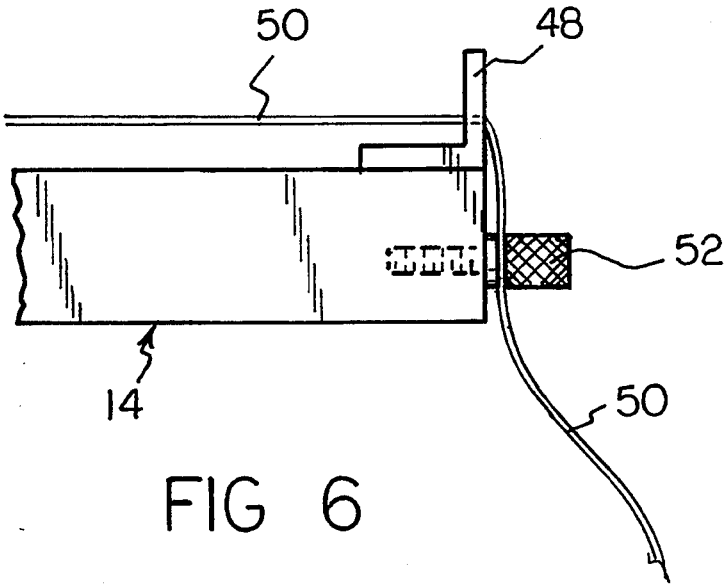
FIG. 6 is an enlarged partial side view of the embodiment of the invention shown in FIG. 5 taken along the line 6—6 thereof, wherein means for providing a taut chalk line are shown.

Turning to FIGS. 5–6, a second embodiment of the invention is shown. Reference numerals are shown that correspond to like reference numerals that designate like elements shown in the other figures. In addition, a chalk line assembly 44 is connected to the second straight edge member 14. The chalk line assembly 44 includes a first chalk line support bracket 46 attached to the second straight edge member 14, a second chalk line support bracket 48 attached to the second straight edge member 14, a portion of a chalk line 50 extending between the first chalk line support bracket 46 and the second chalk line support bracket 48, and a chalk line locking assembly 52 for locking the portion of the chalk line 50 which extends between the first chalk line support bracket 46 and the second chalk line support bracket 48 in a taut and straight orientation. The second chalk line support bracket 48 includes an aperture 54 through which tile chalk line 50 passes like through an eye of a needle. The chalk line locking assembly 52 includes a threaded knurled lock nut that screws into complementary threads in the second straight edge member 14. More specifically, The first chalk line support bracket 46 is attached to the inner member 32, and the second chalk line support bracket 48 is attached to the outer member 33 of the second straight edge member 14.

In use, tile angle between the T-shaped first straight edge member 12 and the second straight edge member 14 is determined and locked into position as described hereinabove. The doorframe template apparatus 10 of the invention is then placed on a door. Then, the chalk line 50 is pressed up against the door to deposit a line of chalk powder on the door. Use of the chalk line 50 precludes the necessity of using a writing instrument to scribe a line onto the door.

Figure 7:
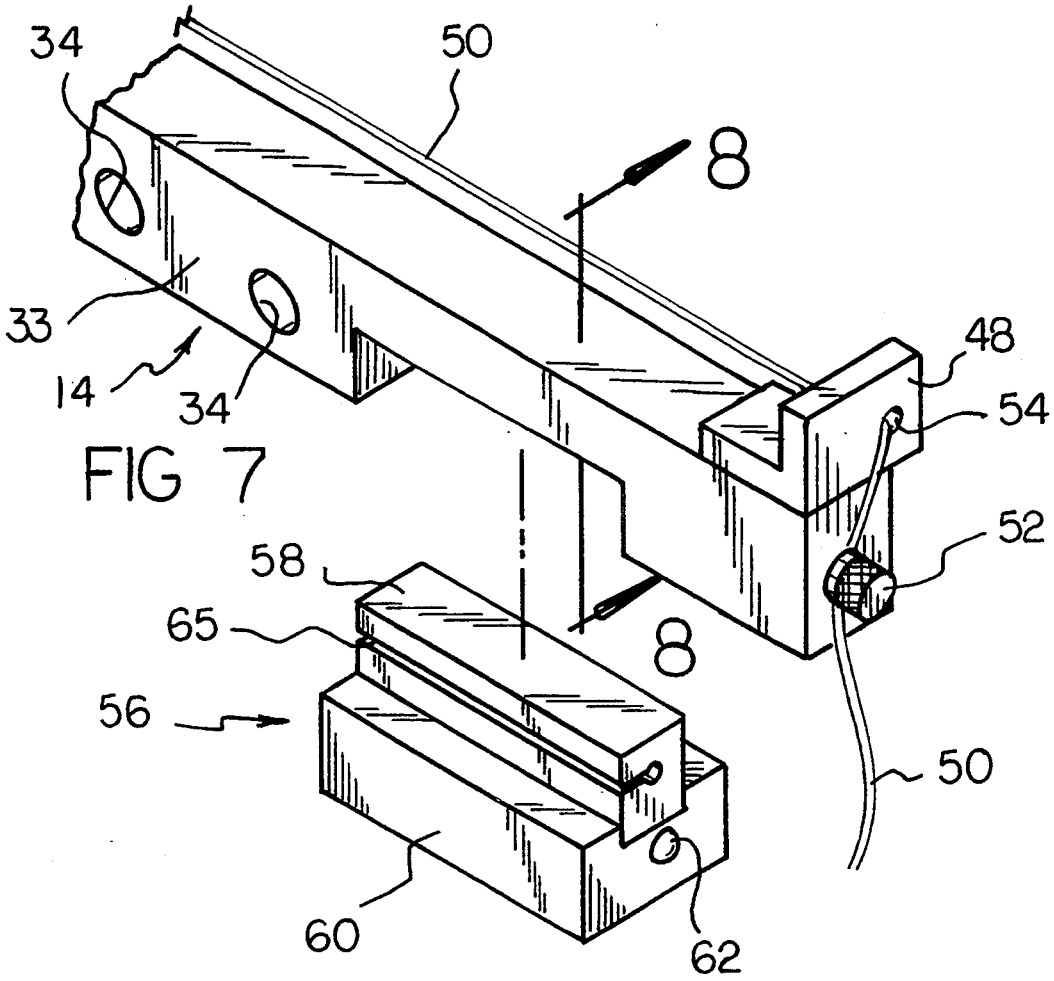
FIG. 7 is a partial perspective view of a preferred third embodiment of the doorframe template apparatus of the invention showing a removable chalk powder supply.
Figure 8:
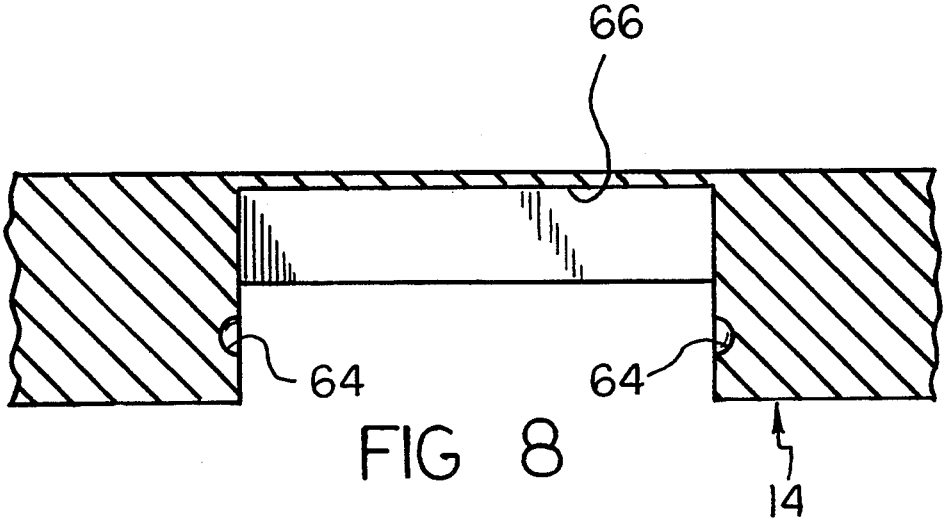
FIG. 8 is a cross sectional view of the embodiment of the invention shown in FIG. 7 taken along the line 8—8 thereof.

Turning to FIGS. 7–8, a third embodiment of the invention is shown. Reference numerals are shown that correspond to like reference numerals that designate like elements shown in the other figures. In addition, a chalk powder supply assembly 56 is removably and replaceably attachable to the second straight edge member 14, for retaining a supply of chalk powder to be applied to the chalk line 50. The chalk powder supply assembly 56 includes a slotted applicator member 58 and a base member 60 for supporting the slotted applicator member 58. The base member 60 includes spring-loaded button members 62 which fit into complementary wells 64 in the second straight edge member 14, such that the chalk powder supply assembly 56 is secured to the second straight edge member 14 when the spring-loaded button members 62 are fitted into the wells 64.

The second straight edge member 14 includes a cavity 66 for receiving the chalk powder supply assembly 56. In operation, the chalk powder supply assembly 56 is removed from the cavity 66. The slot 65 of the slotted applicator member 58 is run along the chalk line 50 to deposit chalk powder on the chalk line 50, and the chalk powder supply assembly 56 is returned to the cavity 66 and secured to the second straight edge member 14 by fitting of the spring-loaded button members 62 into the wells 64.

The components of the doorframe template apparatus of the invention can be made from inexpensive and durable metal, e.g. aluminum, or plastic materials.

It is apparent from the above that the present invention accomplishes all of the objects set forth by providing a new and improved doorframe template apparatus that is low in cost, relatively simple in design and operation, and which may advantageously be used to assure that the shape of the door conforms to the shape of the doorframe. With the invention, a doorframe template apparatus is provided which retains the shape of a doorframe so that the retained shape can be transferred to a door. With the invention, a doorframe template apparatus is provided which is lightweight and easy to operate. With the invention, a doorframe template apparatus is provided which is easily adjusted to successively measure all four corners of the doorframe. With the invention, a doorframe template apparatus is provided which includes a relatively long portion to conform to a vertical doorjamb and a relatively short portion to conform to a horizontal portion of the doorframe. With the invention, a doorframe template apparatus is provided which permits accurate transfer of the shape of the doorframe corner to the door. With the invention, a doorframe template apparatus is provided which is adjustable with respect to doorframe width. With the invention, a doorframe template apparatus is provided which is a square-containing device which possesses specific features designed for assuring that the shape of a door conforms to the shape of the doorframe. With the invention, a doorframe template apparatus is provided which assures that a straight line is drawn on a door. With the invention, a doorframe template apparatus is provided which employs a chalk line with provisions to assure that the chalk line remains taut and straight. With the invention, a doorframe template apparatus is provided which provides a supply of chalk to replenish depleted chalk. With the invention, a doorframe template apparatus is provided which provides a chalk supply that can readily be added to or removed from the support for the chalk line.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A doorframe template apparatus for use with a doorframe having vertical doorjambs and horizontal doorframe members spanning between tops of the doorframe members, said apparatus comprising:

a T-shaped first straight edge member including a straight top member and a straight middle member extending perpendicularly from a middle portion of said top member, said straight top member including a top flange member and a bottom flange member at right angles to said straight middle member, a second straight edge member, said second straight edge member includes an inner member and an outer member connected to said inner member, said outer member being adjustable relative to said inner member, a top surface of said outer member being in the same plane as a top surface of said bottom flange member, a pivoted joint connecting said straight middle member with said second straight edge member adjacent to said bottom flange member for adjustably securing said T-shaped first straight edge member to said second straight edge member at adjustable angles that conform to respective doorframe angles when said straight top member of said T-shaped first straight edge member is placed against a doorjamb and said second straight edge member is placed against a horizontal doorframe member, and a lock assembly located at said pivoted joint for locking said T-shaped first straight edge member to said second straight edge member at a selected angle.

2. The apparatus described in claim 1 wherein:

said straight middle member includes a first aperture, said second straight edge member includes a second aperture, and said lockable pivoted joint includes a threaded bolt and a lock nut secured to said threaded bolt, said threaded bolt passing through said first aperture and second aperture, when said first aperture and said second aperture are placed in registration.

3. The apparatus described in claim 2 wherein said second straight edge member includes an upper straight edge and a lower edge which includes a curved portion near said second aperture, such that said second straight edge member is capable of being rotated around said threaded bolt without being prevented from rotating by the bottom flange member of said straight top member.

4. The apparatus described in claim 1 wherein an inner side of the second straight edge member includes a series of indicia which indicate a number of angles at which said second straight edge member can be oriented with respect to said T-shaped first straight edge member.

5. The apparatus described in claim 4 wherein a top portion of said straight middle member of said T-shaped first straight edge member includes an obtuse-angled notched edge which permits said indicia to be viewed by a user of said apparatus.

6. The apparatus described in claim 1 wherein said inner member and said outer member include a plurality of adjustment apertures which are capable of being placed in registration and secured to each other by second straight edge locking assemblies.

7. The apparatus described in claim 1 wherein said top surface of said bottom flange member and said top surface of said outer member are coplanar with respect to plane of a door, such that when said T-shaped first straight edge member and said second straight edge member are placed on the door, both the T-shaped first straight edge member and the second straight edge member are coplanar with the door.

* * * * *